US005209360A

United States Patent [19]

Valiulis

[11] Patent Number: 5,209,360

[45] Date of Patent: May 11, 1993

[54] SHELF DIVIDER

[75] Inventor: Stanley C. Valiulis, Rockford, Ill.

[73] Assignee: Southern Imperial, Inc., Rockford, Ill.

[21] Appl. No.: 881,233

[22] Filed: May 11, 1992

[51] Int. Cl.[5] ..... A47F 5/00

[52] U.S. Cl. ..... 211/184; 108/61

[58] Field of Search ..... 211/184, 43, 86; 108/60, 61

[56] References Cited

U.S. PATENT DOCUMENTS 4,899,668 2/1990 Valiulis ..... 108/61

FOREIGN PATENT DOCUMENTS 1435596 3/1966 France ..... 211/184

OTHER PUBLICATIONS

Sample label holder for a "Pegboard" hook and sold by Southern Imperial, Inc.

*Primary Examiner*—Robert W. Gibson, Jr.

*Attorney, Agent, or Firm*—Leydig, Voit & Mayer

[57] ABSTRACT

The divider includes an elongated rod adapted to be attached removably to a mounting bracket made of plastic. The bracket includes an upright strip having a resiliently hinged tongue which is adapted to be wedged between a shelf and an adjacent wall in order to hold the divider in a fixed but adjustable position on the shelf.

7 Claims, 1 Drawing Sheet

SHELF DIVIDER

BACKGROUND OF THE INVENTION

This invention relates to a divider for use on a retail shelf to separate the shelf into zones and help keep the merchandise in each zone in a neat and orderly arrangement. More particularly, the invention relates to a divider for a shelf which projects forwardly from an upright wall.

SUMMARY OF THE INVENTION

The general aim of the present invention is to provide an extremely simple and inexpensive divider which may be quickly and easily installed and which may be infinitely adjusted along the shelf.

A more detailed object of the invention is to achieve the foregoing by providing a shelf divider having a mounting bracket made of a single piece of plastic and adapted to resiliently wedge between the shelf and the wall in order to hold the divider in place while allowing the divider to be adjusted along the shelf.

The invention also resides in the relatively simple and inexpensive extruded construction of the mounting bracket.

These and other objects and advantages of the invention will become more apparent from the following detailed description when taken in conjunction with the accompanying drawings.

DETAILED DESCRIPTION OF THE PREFERRED EMBODIMENT

Figure 1:
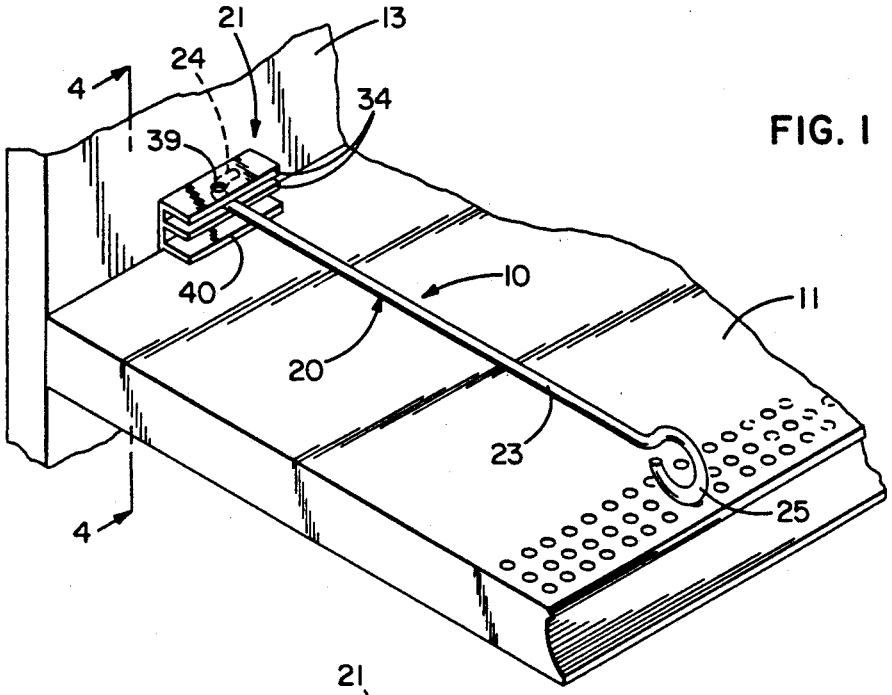
FIG. 1 is a fragmentary perspective view of a typical shelf equipped with a new and improved divider incorporating the unique features of the present invention.

For purposes of illustration, the present invention has been shown in the drawings as embodied in a divider 10 which may be used to separate a merchandise display shelf 11 into different zones. Several dividers may be used on one shelf and serve to keep the merchandise in the zones neat and orderly while preventing mingling of merchandise in adjacent zones.

Figure 4:
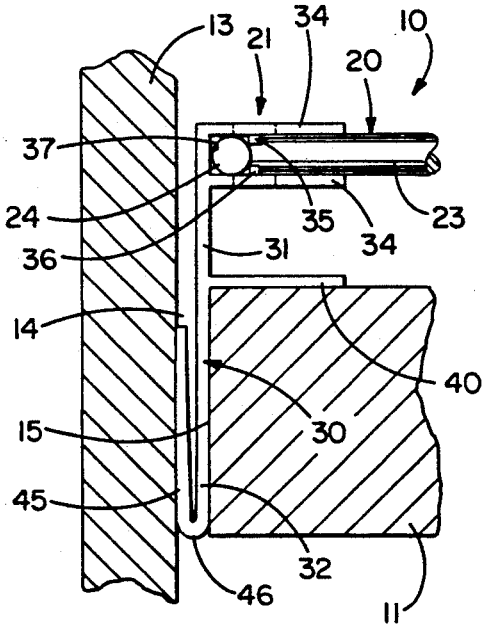
FIG. 4 is an enlarged fragmentary cross-section taken substantially along the line 4—4 of FIG. 1.

In the present instance, the shelf 11 extends outwardly from an upright wall 13 and is supported by underlying brackets (not shown) connected to the wall. A narrow gap 14 (FIG. 4) exists between the wall and the rear edge 15 of the shelf.

The present invention contemplates the provision of a relatively inexpensive two-piece divider 10 which may be infinitely adjusted to any desired position along the shelf 11. The divider is characterized in that it includes a dividing member 20 formed by a single piece of wire and supported by a mounting bracket 21 formed by a single piece of resiliently yieldable material such as plastic.

More specifically, the dividing member 20 includes a rear-to-front extending rod 23 which serves to separate the shelf 11 into adjacent zones. Formed integrally with and extending generally perpendicular to the rear end of the rod is a short mounting finger 24. While the rod and finger may be made of various materials, they preferably are formed from a single piece of wire. The forward end portion of the rod may be looped into a ring 25 which engages the upper side of the shelf adjacent the forward edge thereof in order to keep the rod spaced above the shelf.

The mounting bracket 21 is made of a suitable plastic such as polyethylene and includes an upright strip 30 having an upper body portion 31 and a lower body portion 32. Formed integrally with and projecting forwardly from the upper body portion 31 of the strip 30 are upper and lower generally horizontal and generally rectangular plates 34. A rib 35 projects downwardly from the upper plate while a similar rib 36 projects upwardly from the lower plate. The two ribs define a channel 37 which detachably receives the finger 24 of the divider member 20 and captivates the divider member against forward and rearward movement relative to the bracket 21.

Figure 2:
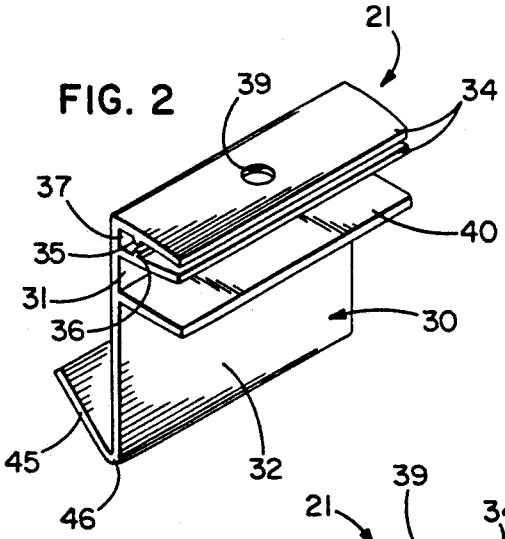
FIG. 2 is an enlarged perspective view of the mounting bracket of the divider shown in FIG. 1.
Figure 3:
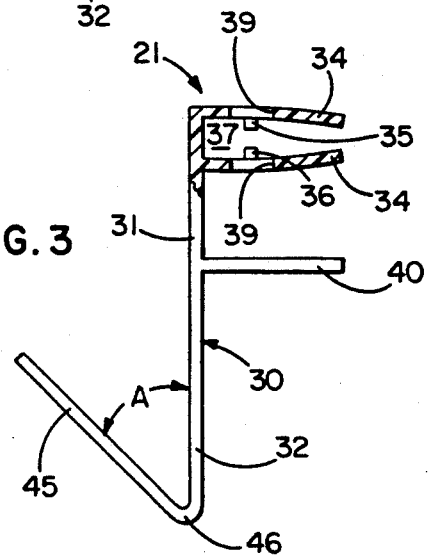
FIG. 3 is an enlarged side elevational view of the mounting bracket illustrated in FIG. 2, portions of the bracket being broken away and shown in section.

As shown most clearly in FIGS. 2 and 3, aligned holes 39 are punched vertically through the plates 34 near the center thereof. As a result, the ribs 35 and 36 are notched in the vicinity of the holes.

The divider member 20 is adapted to be assembled with the mounting bracket 21 by slipping the finger 24 endwise into one end of the channel 37 and by moving the divider member laterally until the rod 23 encounters and seats within the notches within the ribs 35 and 36. Such seating restricts further lateral movement of the divider member and causes the latter to be held releasably in a fixed position relative to the bracket.

The lower body portion 32 of the strip 30 of the bracket 21 is adapted to be slipped downwardly into the gap 14 between the wall 13 and the rear edge 15 of the shelf 11. In order to limit downward movement of the bracket 21, a rectangular stop flange 40 is formed integrally with and projects forwardly from the strip at the junction between the upper and lower body portions 31 and 32 thereof, the flange extending parallel to the lower plate 34. When the lower body portion 32 of the strip has been inserted downwardly a predetermined distance into the gap 14, the lower side of the flange 40 engages the upper side of the shelf 11 to prevent further downward movement. Engagement of the flange with the shelf stabilizes the bracket 21 and causes the rear portion of the divider member 20 to be held in vertically spaced relation with the shelf.

In carrying out the invention, means on the strip 30 resiliently wedge between the shelf 11 and the wall 13 to frictionally resist upward movement of the bracket 21 and to restrict lateral movement of the bracket along the edge 15 of the shelf. Herein, these means comprise an elongated tongue 45 which is integrally and resiliently hinged at 46 to the lower margin of the lower body portion 32 of the strip 30. The tongue 45 extends upwardly and rearwardly from the strip. When the plastic of the bracket 21 is in a relaxed state as shown in FIG. 3, the included angle A between the strip 30 and the tongue 45 is approximately 45 degrees.

With the foregoing arrangement the bracket 21 may be installed simply by slipping the tongue 45 and the lower body portion 32 of the strip 30 downwardly into the gap 14 between the shelf 11 and the wall 13. As an incident thereto, the tongue is flexed toward the strip and is resiliently loaded. The tendency of the tongue to spring back toward its original position creates a force which frictionally resists movement of the bracket 21 and keeps the bracket in a stable position. By manually overcoming the frictional force, the bracket may be moved to any desired position along the shelf 11 or may be removed therefrom.

From the foregoing, it will be apparent that the present invention brings to the art an infinitely adjustable shelf divider 10 in which the divider member 20 is made from a single piece of wire or like material while the mounting bracket 21 is made from a single piece of plastic. Moreover, the bracket may be formed by an inexpensive extrusion process and by cutting individual brackets from a relatively long length of extruded material. The only other secondary operation involves the punching of the holes 39, and this can be accomplished at the same time the brackets are cut to length.

I claim:

1. A divider for use with a generally horizontal shelf extending outwardly from an upright wall and having a rear edge located adjacent and extending laterally of the wall, said divider comprising a mounting bracket adjacent the rear edge of said shelf and further comprising an elongated dividing member attached to and extending forwardly from said bracket, said bracket being made of a single piece of resiliently yieldable material and comprising an upright strip having a portion adapted to be inserted between said wall and the rear edge of said shelf, first means integral with and projecting forwardly from said strip and engageable with the upper side of said shelf adjacent the rear edge thereof to prevent downward movement of said bracket relative to said shelf, and second means integral with and hinged to said strip and adapted to be resiliently loaded between said wall and the rear edge of said shelf to frictionally restrict upward movement and lateral movement of said bracket relative to said shelf.

2. A divider as defined in claim 1 in which said first means comprise a generally horizontal flange projecting forwardly from said strip.

3. A divider as defined in claim 1 in which said second means comprise a tongue integral with and extending upwardly and rearwardly from the lower margin of said strip, the junction between said strip and said tongue defining a resiliently yieldable hinge permitting said tongue to flex forwardly and rearwardly relative to said strip.

4. A divider for use with a generally horizontal shelf extending outwardly from an upright wall and having a rear edge located adjacent and extending laterally of the wall, said divider comprising a mounting bracket adjacent the rear edge of said shelf and further comprising an elongated dividing member attached to and extending forwardly from said bracket, said bracket being made from a single piece of resiliently yieldable plastic and comprising an upright strip having a lower body portion adapted to be inserted between said wall and the rear edge of said shelf, means integral with said strip and located above said lower body portion for holding said dividing member, a flange integral with said strip below said means, said flange projecting forwardly from said strip and being engageable with the upper side of said shelf adjacent the rear edge thereof to prevent downward movement of said bracket relative to said shelf, a tongue integral with and extending upwardly and rearwardly from the lower margin of the lower body portion of said strip, said tongue being hinged resiliently to the lower body portion of said strip and being flexed toward said lower body portion when the latter is inserted between said wall and the rear edge of said shelf, said tongue pressing resiliently against and frictionally engaging said wall to restrict upward movement and lateral movement of said bracket relative to said shelf.

5. A divider as defined in claim 4 in which said tongue extends upwardly and rearwardly from the lower body portion of said strip at an included angle of about 45 degrees when the plastic of said bracket is in a relaxed state.

6. A divider as defined in claim 4 in which said dividing member comprises an elongated rod and further comprises a horizontal finger integral with and extending substantially perpendicular to one end of said rod, said means comprising a pair of upper and lower plates formed integrally with and projecting forwardly from said strip above said flange, said plates and said flange extending generally parallel to one another, and ribs projecting downwardly from said upper plate and upwardly from said lower plate and defining a channel for receiving and releasably captivating said finger.

7. A divider as defined in claim 6 further including aligned holes formed vertically through said plates and interrupting said ribs, said rod being located between said holes and being captivated releasably against lateral movement by said ribs.

* * * * *